US007518050B2

(12) United States Patent
Stannard

(10) Patent No.: US 7,518,050 B2
(45) Date of Patent: Apr. 14, 2009

(54) FOLDED PERCUSSION INSTRUMENTS

(76) Inventor: John Stannard, c/o 2140 Range Rd., Unit C, Clearwater, FL (US) 33765

( * ) Notice: Subject to any disclaimer, the term of this patent is extended or adjusted under 35 U.S.C. 154(b) by 0 days.

(21) Appl. No.: 11/924,755

(22) Filed: Oct. 26, 2007

(65) Prior Publication Data

US 2008/0105102 A1 May 8, 2008

Related U.S. Application Data

(60) Provisional application No. 60/856,956, filed on Nov. 6, 2006.

(51) Int. Cl.
*G10D 13/08* (2006.01)

(52) U.S. Cl. ..... 84/402

(58) Field of Classification Search ..... 84/402–406, 84/422.1, 422.2, 422.3, 411 R
See application file for complete search history.

(56) References Cited

U.S. PATENT DOCUMENTS 4,807,510 A * 2/1989 Croteau ..... 84/402

FOREIGN PATENT DOCUMENTS

WO WO9318503 * 9/1993

* cited by examiner

*Primary Examiner*—Kimberly R Lockett
(74) *Attorney, Agent, or Firm*—Dennis G. LaPointe

(57) ABSTRACT

A percussion instrument, which includes a cymbal, wherein the instrument is formed with a bent or folded area along one or more lines, planes, or curves of the instrument resulting in the creation of equal or unequal distinct sections.

3 Claims, 10 Drawing Sheets

FOLDED PERCUSSION INSTRUMENTS

RELATED APPLICATION

This application claims the benefit of U.S. Provisional Patent Application 60/856,956 filed Nov. 6, 2006.

FIELD OF THE INVENTION

The invention relates to percussion instruments, in particular to folded percussion instruments.

BACKGROUND OF THE INVENTION

By way of background to further understand the invention described hereinafter, the following definitions are provided.

Node: A point or area in a vibrating material or musical instrument where less vibration or very little vibration occurs.

Overtones: Overtones can be heard as simpler tones or vibrations of a single frequency which, when combined, make up the whole of a musical sound. In cymbals, gongs, and hybrid percussion instruments, there is a complex matrix of overtones comprising the whole.

Swell: A term in music and in describing cymbal and percussion sound, whereby after the instrument is struck, sound grows over time from low to high amplitude. In cymbals (especially those known as crash cymbals), a rise in the frequency and complexity or number of overtones accompanies the rise in amplitude. Instruments with a relatively slow rise to full amplitude are deemed to have a greater degree of swell versus those instruments with a fast rise in amplitude.

Hybrid Instrument: As defined here, an instrument which, due to specific forming techniques, shapes, and materials, is suspended in ways similar to a gong while producing sounds similar to both cymbals and gongs. Such an instrument can be embodied in a variety of shapes, not limited to shapes resembling gongs. The defining factors are that such instruments are suitable to be struck by drumsticks, are suspended from flexible members such as cord, chain or cable at points other than the center node of a disc or dome shape as in cymbals and that these instruments are capable of complex mid and or high frequency overtone structure similar to cymbals as well as low pitch swell as found in gongs.

Attack: The sound heard immediate after the striking of a percussion instrument. The attack is also defined as amount of time it takes for the sound of a percussion instrument to reach full volume or amplitude after a single strike. For example, an instrument with a large amount of swell (such as a large gong or cymbal struck with a soft mallet) would have a slow attack, while an instrument such as a bell struck with a metal clapper or a triangle would have a fast attack.

Hum note: In percussion instruments, such as large bells, cymbals, and gongs, as well as hybrid instruments, there exists a low frequency sound which is, depending on the instrument, loud or soft in amplitude. In cymbals this note is much lower in frequency than the accompanying overtones, and is ideally much lower in amplitude. Some cymbal makers seek to reduce the amplitude of the hum note as it can interfere with the low frequency spectrum of music. String, wind and other non-percussive instruments, feature a low note called a fundamental tone which is the basis for a series of overtones, which are in frequency based on precise integer multiples of this fundamental, and are thus regarded as being "in tune." The hum notes and the overtones of cymbals, gongs and hybrid instruments are not integer based, or tuned to a specific pitch and are thus "not in tune."

Generally, percussion instruments such as gongs and thundersheets have historically been constructed in a few traditional shapes.

Traditional gong shapes are: a disc with a rounded edge which can in the case of southeast asian style gongs be curved into a reverse or negative curve; a disc with a slight domed shape with a flattened center; or various creative shapes with curved edges. Gongs often have curved edges but these are simply rounded edges of a single-sectioned instrument. They do not teach the bending along a line involved in the present invention described below.

Thundersheets have by definition been flat sheets of metal which can be struck or shaken.

Flextones do feature bent metal but for an entirely different purpose. The flextone is a small hand held instrument which is manually flexed while playing to alter a fundamental frequency. Few overtones exist in the flextone. It basically vibrates in a single mode to produce a pronounced, single note which varies in frequency according to manually applied varying tension applied by the musician. The instrument is shaken while playing and has a built-in mallet to repeatedly hit the vibrating surface. As the flextone is flexed, the single note rises in frequency.

The small flextone instrument in no way teaches the benefits of this invention which vibrates in very complex modes and produces a multitude of low and high frequencies simultaneously.

Cymbals have been constructed in many variations of the traditional shape but have never featured sections which are bent or folded along lines.

In each case, prior art vibrated in complex modes but within a single section, and without the use of a folded shape.

SUMMARY OF THE INVENTION

Generally, the present invention is a percussion instrument, wherein said instrument comprises a bent or folded area along one or more lines, planes, or curves of the instrument resulting in the creation of equal or unequal distinct sections.

The instrument can further comprise slots cut or grooved into the material of the instrument.

The instrument can be bent or folded so as to form a resonant air cavity.

The folded area can be created by joining adjacent portions of the percussion instrument to simulate such folds.

The invention can further comprise means for attaching the instrument from a desired location, where the means for attaching the instrument is located along a predetermined portion of bent or folded area of the instrument. For example, the attachment means can comprise a center node hole located proximate a center of said bent or folded area, and can be configured so as to achieve a suspended, rotating effect.

In one embodiment, the percussion instrument is a cymbal which is bent or folded along interrupted lines along an edge of said instrument and one or more portions of said edge is bent or folded.

In another embodiment, the percussion instrument is a gong which is bent or folded along interrupted lines.

In still another embodiment, the percussion instrument's bent or folded area is configured so as to form additional mass or weight to be added to an area adjacent to said sections, causing a change in sound or overtone structure of said instrument.

The percussion instrument may have a single straight bent or folded area and located so as to facilitate an easy placement or removal of said instrument on or off an existing percussion stand arm (cymbal stand), wherein the instrument can be struck to produce a percussive, rattling, musical sound. This instrument can be removed from the stand and hung onto a loop of flexible cord to use as a bell, gong, or hybrid percussion instrument. This instrument can be formed as a rattling instrument which can be struck to produce a loud rattling tone of considerable complexity of overtones and wherein said instrument can be removed from said stand and placed upon a flexible suspension member to produced a sustained sound.

In another embodiment, the percussion instrument may be configured to be folded into an accordion shape.

DETAILED DESCRIPTION OF THE INVENTION

Figure 1:
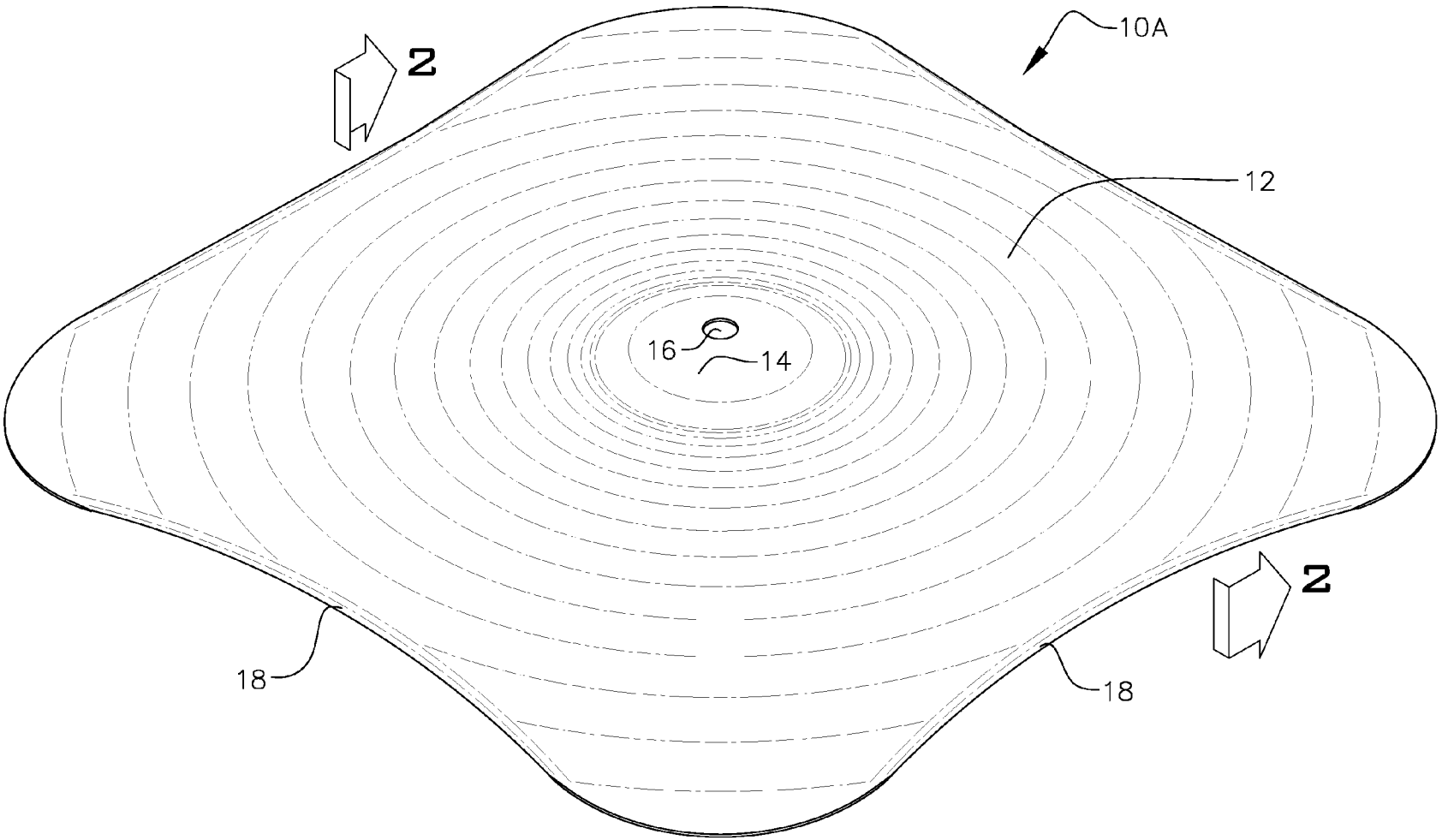
FIG. 1 is a conceptual representative drawing of a cymbal, which is bent or folded along interrupted lines along an edge of the cymbal where only a portion or portions of the edge is bent or folded.

Prior to referring to the drawings, a general description regarding the manufacture of various embodiments of the present invention follows.

1. Create the initial shape and general thickness of the instrument, and if desired, hammer, roll and/or heat treat and generally shape the instrument in ways which affect sound.
2. Form one or more creases in the instrument to create two or more distinct sections of equal or differing size.
3. Shape further, heat treat if needed, and finish the instrument.

Nickel-Iron Grain Refiners in Bronze Percussion Instruments:

While ductility is necessary to form the shapes in this invention, the final product must be exceedingly strong and resilient to withstand consumer use. It must hence resist deformation during use while being quite flexible. In many alloys, the metal is quite ductile (easily deformed without cracking or failure) when in the soft or partially softened state. These softer states of metal, while quite ductile, are not as strong as the hardened levels of temper in any given alloy. Temper ratings of certain alloys, especially those which are strengthened through cold work methods such as rolling, hammering or other methods which can reduce the thickness of said metal and reduce grain size and elongate the grain structure of the alloy, are rated by the percent of elongation remaining in the alloy before the metal will fail in tension. Phosphor bronze is hardened and strengthened by cold work. Phosphor bronze alloys are typically composed of copper, tin and a small amount of phosphorous.

A typical phosphor bronze, when hardened to a strength rating of extra spring temper, can only be elongated by an additional 2% before failing and breaking or cracking in tension. The addition of small amounts of iron and nickel can refine and reduce grain size and hence, increase strength. Through the addition of iron and nickel, ideally in ranges of between 0.05 to 0.20% each, strength can be increased considerably. By utilizing these grain refiners, a temper with more elongation remaining in the alloy can be used.

A temper rating of extra hard in such an alloy, will possess strength equal to extra spring in a typical bronze alloy. This extra hard temper can be elongated considerably more than extra spring temper hence allowing the deformation needed to easily form this invention. In short, a softer and more ductile temper of grain refined bronze can be stronger than a hard, more brittle temper of traditional bronze.

While nickel iron grain refiners are known to increase low tin bronze strength, they are not known to increase sound quality. Low tin bronze alloys are thought to be of high pitched and of narrow range compared to equal high tin alloys in sound quality. The inventor has found that by using nickel iron grain refiners in low tin, more affordable and workable alloys, a percussion or cymbal maker can increase taper, use of heat zones, depth and greater variations of hammering and other processes, which create a structurally more complex instrument to realize a product of superior complexity of overtone structure, higher strength and a product which lends itself to greater affordability of quality control. Such processes such as greatly increased tapering would weaken common alloys but the added strength provided by nickel iron grain refiners allows the use of these special processes and features.

Many bronze instruments shared many vibrational characteristics with cymbals. Advertising copy from the two largest cymbal manufacturers teaches away from use of low tin alloys for high quality percussion instruments by mentioning that their own product lines made of low tin alloys are of affordable, mass produced and identical quality when compared to their high tin alloy products. For example, the Sabian.com Web site advertising in referring to low tin alloy called B8 phrases point to an image of affordability: "rapid tech virtual cloning"; limited range of overtone structure is advertised: "focused sound"; "Lowest possible prices" all teach away from low tin alloys for use in quality cymbals and percussion. The Zildjian company (the leading cymbal maker) advertises "ultra modern crafting techniques", "higher pitch", "more focused overtones", "identical discs". Such phrases teach away from very high quality to cymbal and percussion consumers, who regard hand crafting and a wider range of overtones desirable. (See http://www.zildjian.com/en-US/products). Conversely the same companies promote their high tin products as works of art with centuries old secret processes which yield high quality, all of which begins with their 20% tin alloy.

The use of nickel-iron grain refiners in this invention offers a method to create new hybrid and vibrato based instrument embodiments of high quality and novel sound while possessing the superior flexural strength need for this invention.

Figure 3:
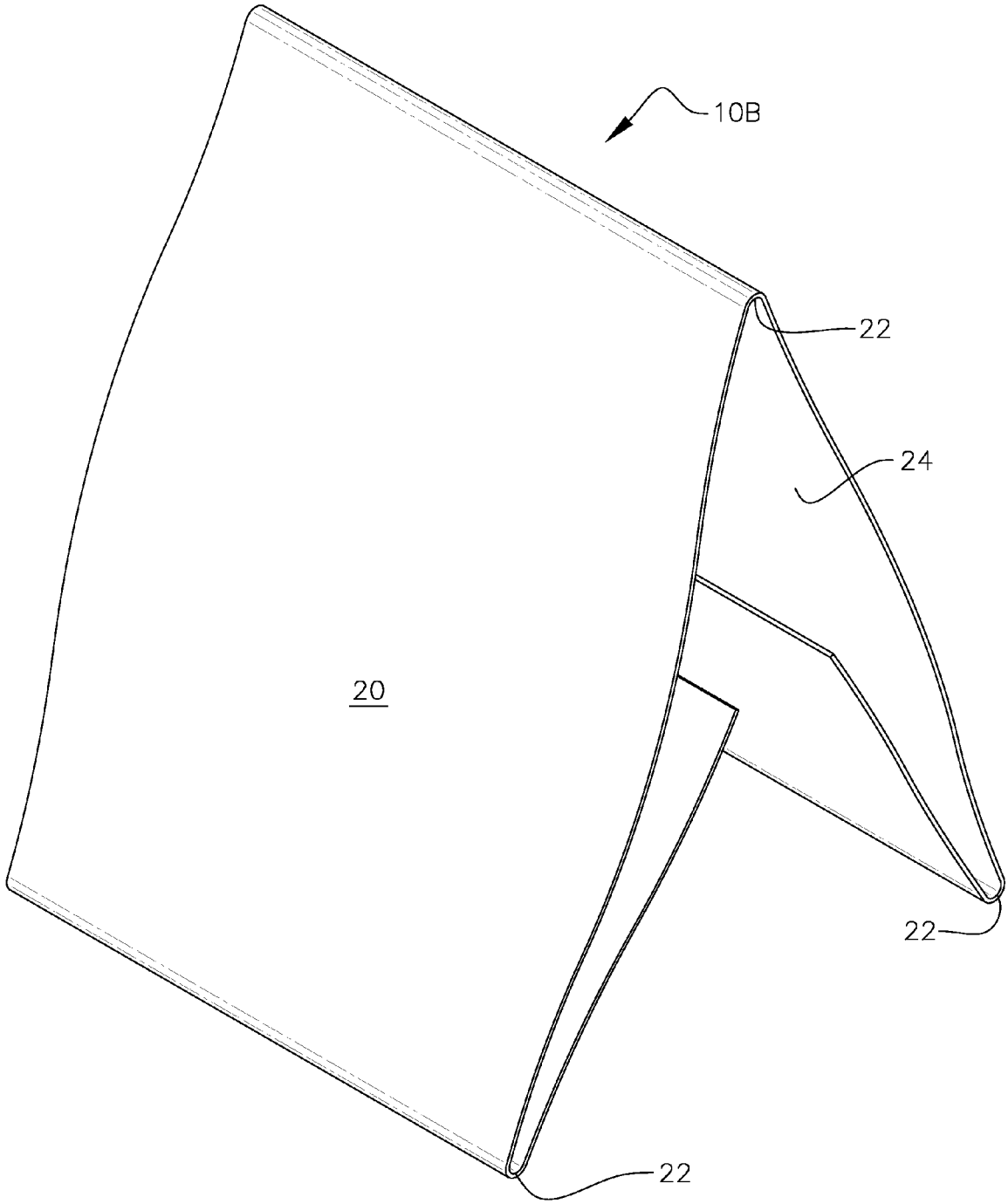
FIG. 3 is an example of a percussion instrument, which is folded in such a way as to create a cavity or chamber area.
Figure 5:
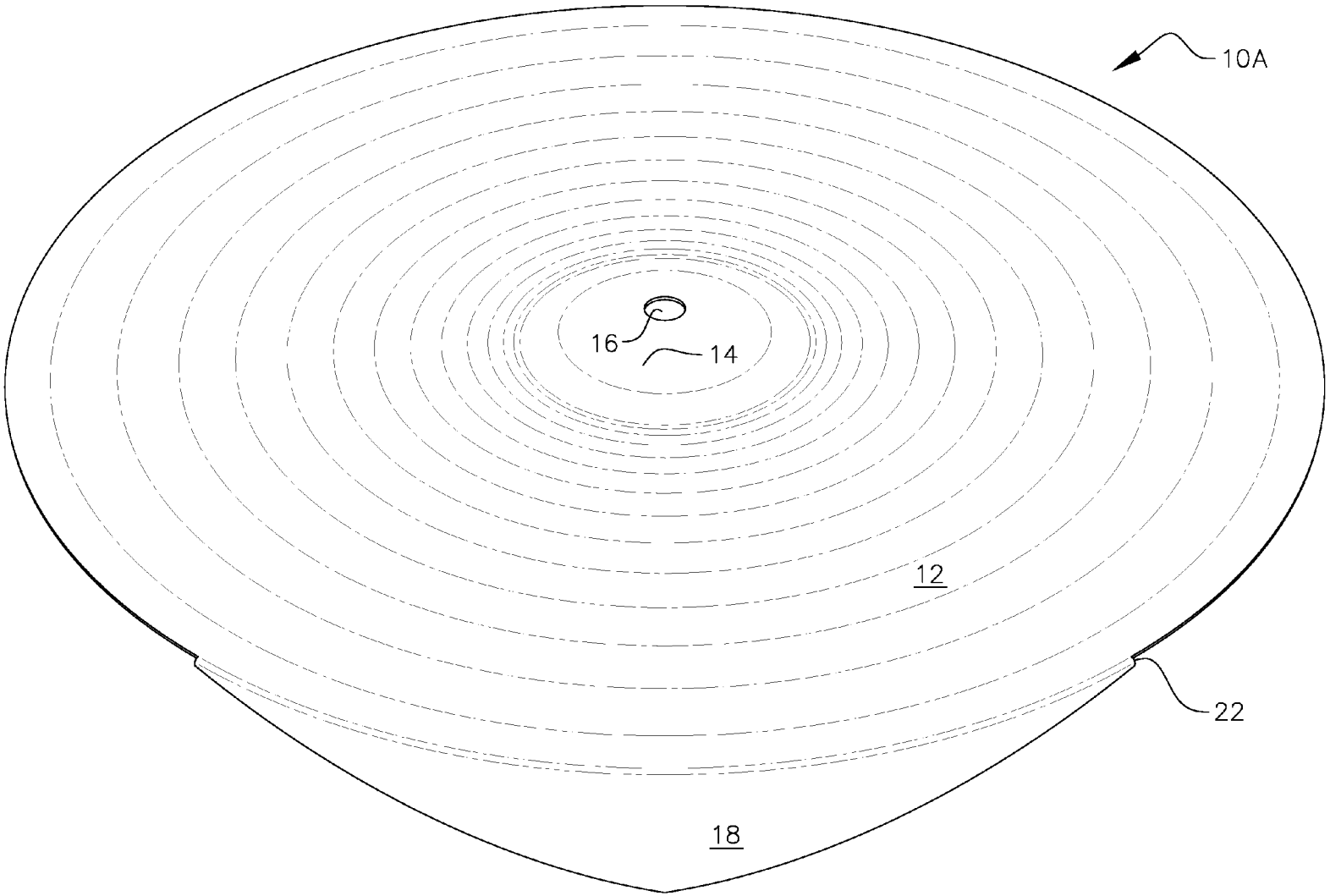
FIG. 5 is a conceptual example of a cymbal, which is bent or folded along interrupted lines along an edge of the cymbal where only a portion or portions of the edge is bent or folded.

Benefits of this instrument class:

1. Savings in space: a 12"×24" instrument when folded in half is only 12" square, yet it retains and can exceed the complex vibrational modes of a 24" long instrument.
2. In some embodiments, increased amplitude of low frequency overtones is achieved, partly due to the resonant air cavity between the sections, and partly due to the formation of added low frequency modes between the sections. These added vibrations can be seen visibly as the instrument opens and closes during vibration. It is noticed that a resonant air cavity is formed even in an instrument which is bent along a single line. Previous musical instrument of many types used resonant air cavities, but these cavities were always more "complete" chambers such as tubes, box shapes or other semi closed chambers.
3. Playability by hand striking or plucking or instrument or support cord techniques which allow a swell in sound without a mallet strike sound. The invention can be plucked with the flesh of two fingers by compressing the folded sections together then slipping downward and releasing quickly to create a sudden swell without striking. Fingernails can be used to yield subtle high frequencies without striking. While cymbals can be plucked, this technique is far more effective due to the ability to compress or "squeeze together" the sections and quickly release to create a louder sound.
4. Playability with drumsticks for a useful cymbal-like sound with very complex overtones, including the striking of the rounded bend area for a range of unique high frequency tones. Unlike a cymbal or gong this invention is designed to allow vigorous striking on the rounded, bent edge for a range of loudness from very soft to very loud without damage to the instrument.
5. The creation of a vibrato effect (a subsonic vibration which modulates the other frequencies) can be achieved by striking areas of lower rigidity such as the lower corners. In embodiments such as are seen in FIGS. 3 and 5, as the folded instrument vibrates, it opens and closes at a low frequency which is heard as a vibrato sound. This vibrato can be varied by the musician with practice to achieve a variety of sounds.
6. Differing length sections allow distinct differences in sound when striking various areas. Vibrato can be significantly greater for example in an instrument with a 10" long back and a 17" long front when striking the bottom of the shorter section.
7. An instantly replaceable cord can be looped around the bent fold, thus eliminating the need to create holes in the instrument. The edges of the bend are easier to polish to a smooth, non-abrasive surface to avoid suspension cord wear. If the cord was tied through holes as in conventional gongs, replacement would take much longer and be impractical. The feature of instantly replaceable cords allows a change in sound through use of various suspension cords. A strong, thin cord will maximize high frequencies and length of sustain. A thick, soft cord will dampen high frequencies and shorten sustain. Cords can be chosen based on the intensity of playing. Very loud playing may need a thicker, stronger cord. Studio recording can utilize a thinner cord to maximize high frequencies. Instantly replaceable cords can also feature small rattling rings known by percussionists as "sizzles" which produce a buzzing sound. These options are made considerably more practical by the feature of the bend in the folded sections which supports a cord without holes.
8. Allowance of bi-metal welding, whereby two or more differing materials or alloys are joined to create dithering sections.
9. Welding to create a more complex non-linear fold or a stronger weld through use of a "wavy shaped" weld.

Figure 8:
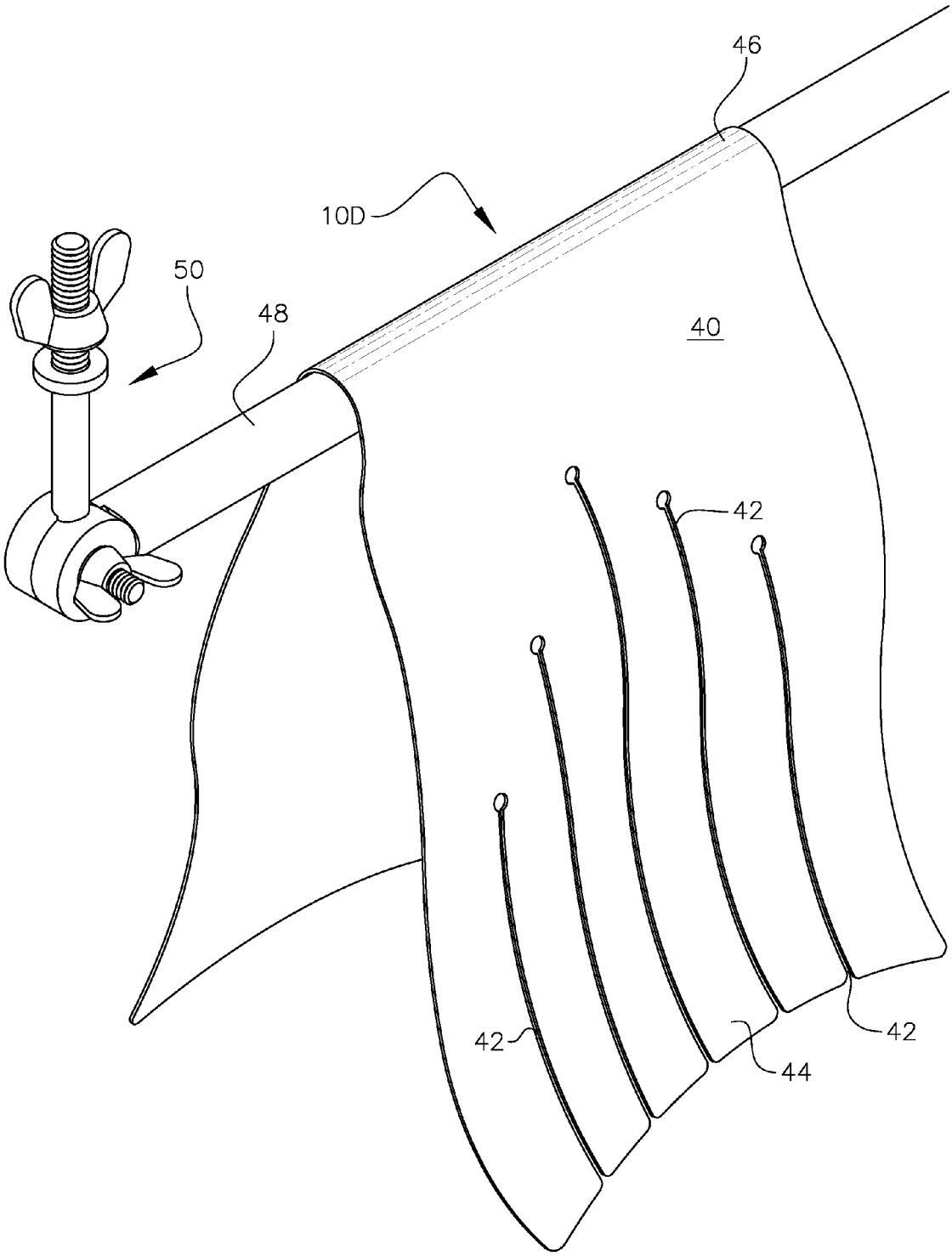
FIG. 8 is a conceptual depiction of a folded percussion instrument in use on a percussion stand adjacent a cymbal attachment support on the cymbal stand, with added slots (in this case open slots as opposed to alternative closed slots) on at least one side of the instrument.
Figure 9:
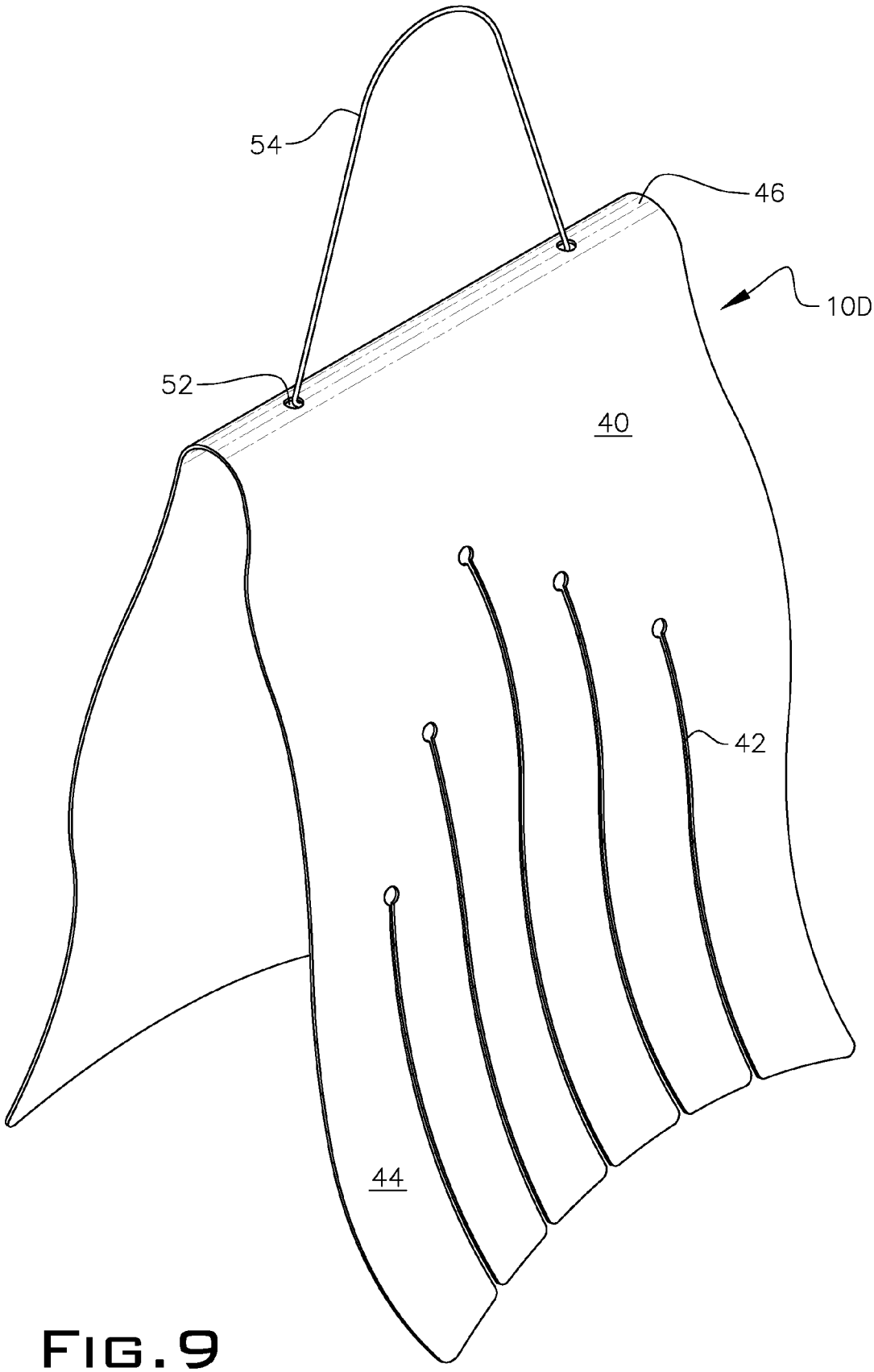
FIG. 9 is a conceptual depiction of the instrument of FIG. 8 with the added lanyard or chord and apertures for vertically suspending the instrument.
Figure 10:
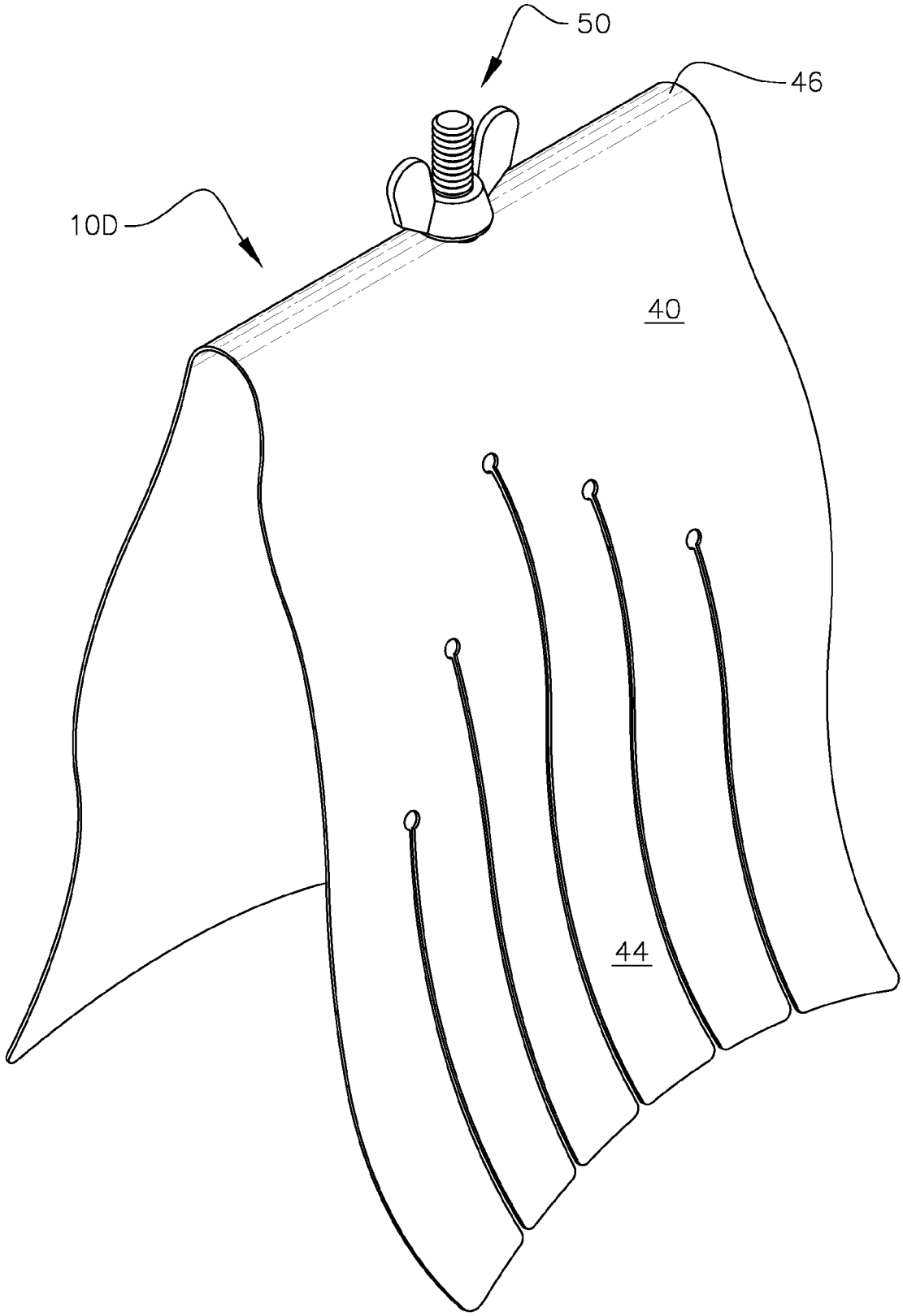
FIG. 10 is a conceptual depiction of the instrument of FIG. 8 mounted instead along the fold line to a cymbal like stand mounting fixture.

Folded A-shaped embodiments of the invention as depicted in FIGS. 3, 4 and 8-10 and respectively enumerated as 10B and 10D, features of a nodal area or area of reduced vibration in the center of the bend 22,46, which can render the instrument suitable for the creation of a center mounting hole similar to that of a cymbal similar to an attachment means as depicted in FIG. 10. A welded attaching device could be used in place of a hole. This eliminates the need for a suspension cord (such as that depicted in FIG. 9 as 54 attached to cord attachment points 52 along fold line 46 and that depicted in FIG. 4 as 26 attached to cord attachment points 28) and hence makes the mount of the invention more applicable for use in a drumset. The elimination of the cord 26,54 makes this variant of the invention more durable since mounting cords can break. When a mounting cord is used in the center of the bend area (the nodal area), it can be much thicker and of higher mass than instruments where a nodal point of mounting is not present. A high mass suspension cord is much more durable than a low mass, thin cord. When used at a nodal point, a high mass cord has little damping effect on the instrument. This unexpected result of a nodal area in folding or bending a long, relatively flat section of metal is a new discovery. Flat, long sections of metal do not feature a node in the center unless bent.

A rotating version of this invention can utilize the center nodal area, allowing the player to strike the instrument in a way which causes it to rotate easily. This rotation feature can be achieved by striking the side of the invention, causing rotation to occur. This rotation can be achieved while the invention is mounted at the center on a cymbal stand 46,50 (see FIGS. 8 and 10), but can also be achieved when the invention is suspended from the center nodal area of reduced vibration by a single cord, rope, or cable 54 from apertures 52, as depicted in FIG. 9. The cord 54 and holes 52 depicted in FIG. 9 are optional as the entire device can be dropped onto a loop of flexible cord in much the same way it can be dropped onto the cymbal stand arm as depicted in FIG. 8. The feature of the node allows a very thick and wear-resistant cord to be used with minimal damping to the sound of the instrument. A swivel or rotation device can be utilized, or the twisting elasticity of the cord or cable can be utilized. The rotating effect causes a cascading phase cancelation in sound which is known by musicians under the common names of "doppler effect", "leslie effect", "chorus effect", or "flanging".

A cymbal with folded edges has several new and useful qualities. FIGS. 1-2 and 5-6 show examples depicted generally as 10A of cymbal 12 designs which are bent at 22 on the parts of the outside edges leaving unbent areas. Cymbals have featured small flanged edges in the past but the edge was a continuous circular flange which encircled the entire edge of the cymbal, as opposed to interrupted edges directed at portions/parts of the outside edges having unbent areas. This increases the rigidity of the cymbal markedly by creation of an outer structural stiffening rib. In the present invention, circular or geometrically shaped cymbals are bent along lines or isolated areas 22 to create geometric shapes in which the outer rib 18 is interrupted at the termination point of each bend. This creates an area in the unbent areas of greater flexibility. The areas of greater flexibility in combination with the bent (more rigid) areas create altered, multiple modes of vibration. In addition, striking the cymbal directly against the bent edge will sound different than striking the unbent edge. The edge, being rounded and presenting a broader surface to the drumstick, will produce a new and unique sound. This bent area also presents a much broader contact point to the drumstick and hence helps preserve the stick in a motion called "slicing" whereby the stick strikes directly at 90 degrees to the edge of the cymbal. In a conventional cymbal, slicing at high impact force is not recommended. It can cause cracking of the cymbal and of shredding the drumstick. It also yields a weak tone as it mostly excites longitudinal vibrations. Slicing in conventional cymbals is limited to low impact, "special effects" sounds. In this invention, slicing neither leads to stick wear or cymbal cracking. Slicing, hence can now become a viable form of striking of the cymbal. The sound produced can be of very fast attack with very little swell, but with a great degree of overtone complexity.

Figure 2:
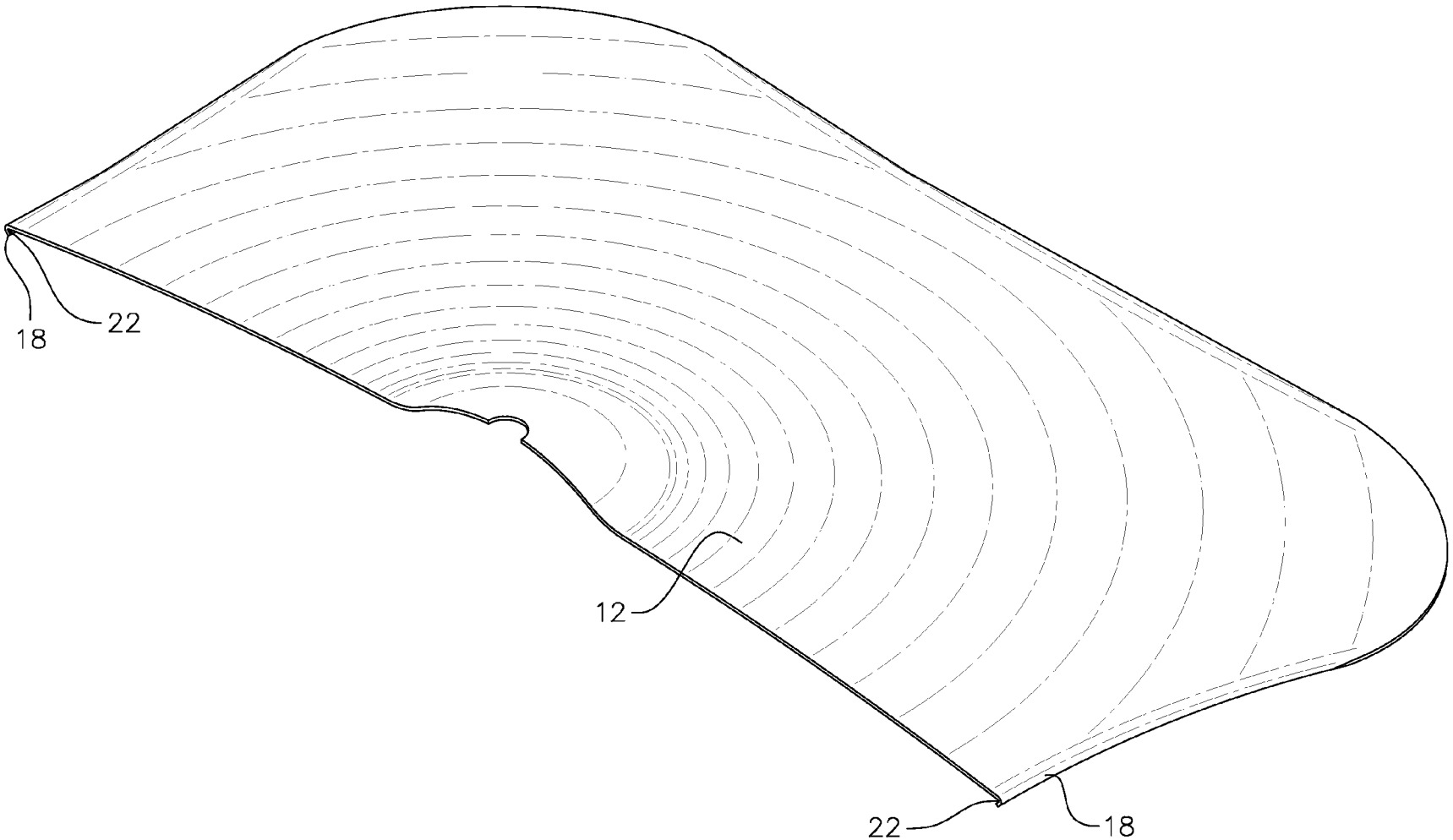
FIG. 2 is a cross-sectional depiction of the cymbal of FIG. 1.

In FIGS. 1 and 2, the embodiment 10A depicted is a square cymbal 12 with dome area 14 and stand mounting hole 16, and is bent in four distinct areas, while the corners are left unbent. The difference in sound produced when striking the corners versus the center of the bent area is pronounced. Corner striking can produce a great degree of swell when a glancing blow is used. Slicing the center of the bent area produces the fast attack sound mentioned above.

Rigidity can be further reduced by slotting the bent sections as shown in FIGS. 7-10. Slotting can also add new vibration zones, which add complexity to the overtone structure and overall sound of the invention. Cymbals, gongs and hybrid instruments can be folded along any number of lines 22, 46 and as few as a single section. For example slots 34,42 may be added to the instrument 10C, 10D (or any other embodiment described herein as FIGS. 7-10 are merely intended to be representative of percussion instruments with added slots, open or closed). When open slots are integrated in the instrument, cantilevers 38,44 are formed. Specifically, in the gong like instrument 30 depicted in FIG. 7, which is suspendable using a cord (not shown) attached to points 32, one or more of the cantilevers 38 may also be bent along fold line 36 to form a folded bent portion 38'.

Figure 6:
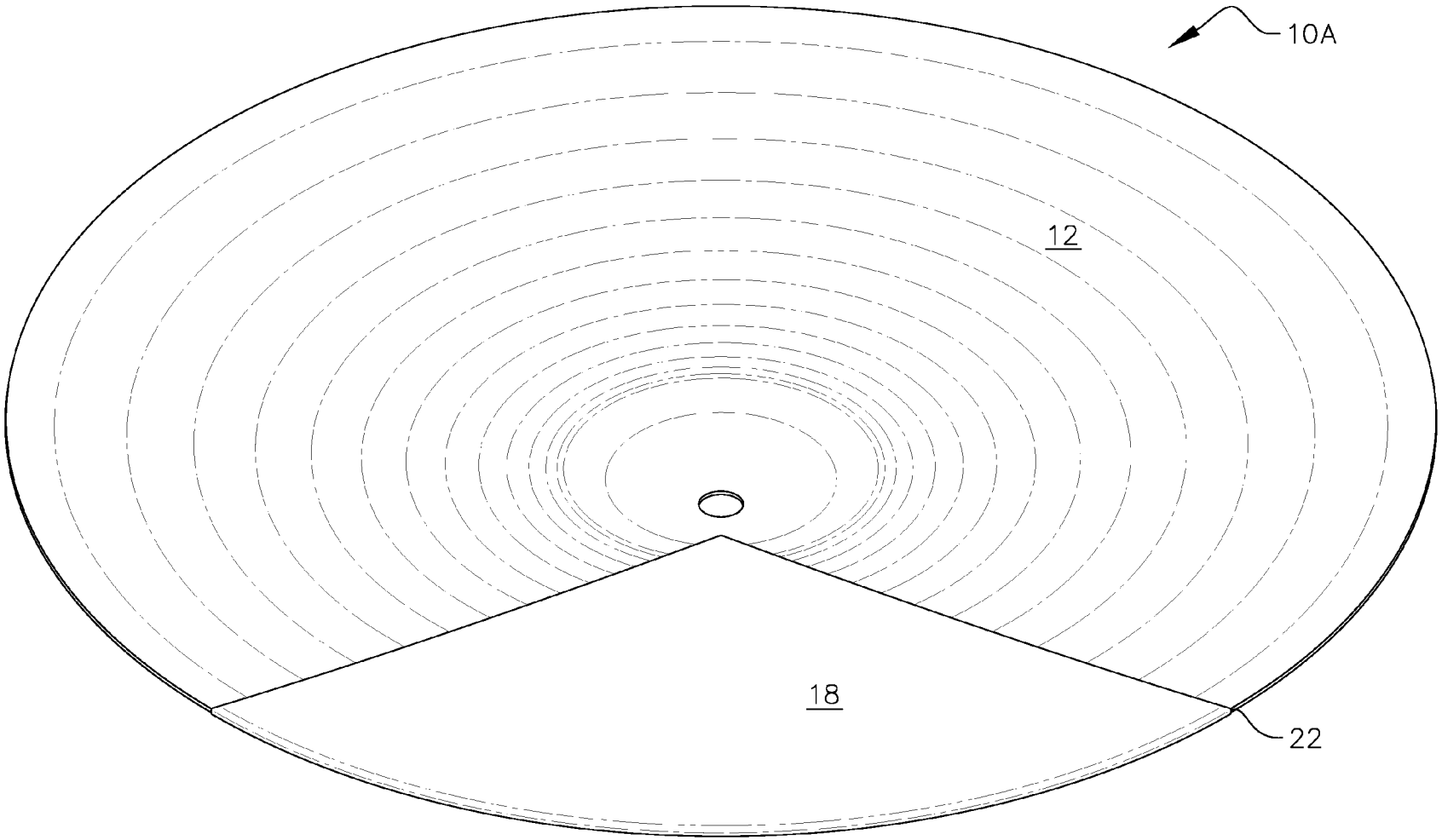
FIG. 6 is an underside view of the cymbal of FIG. 5, which is bent or folded along interrupted lines along an edge of the cymbal where only a portion or portions of the edge is bent or folded.
Figure 7:
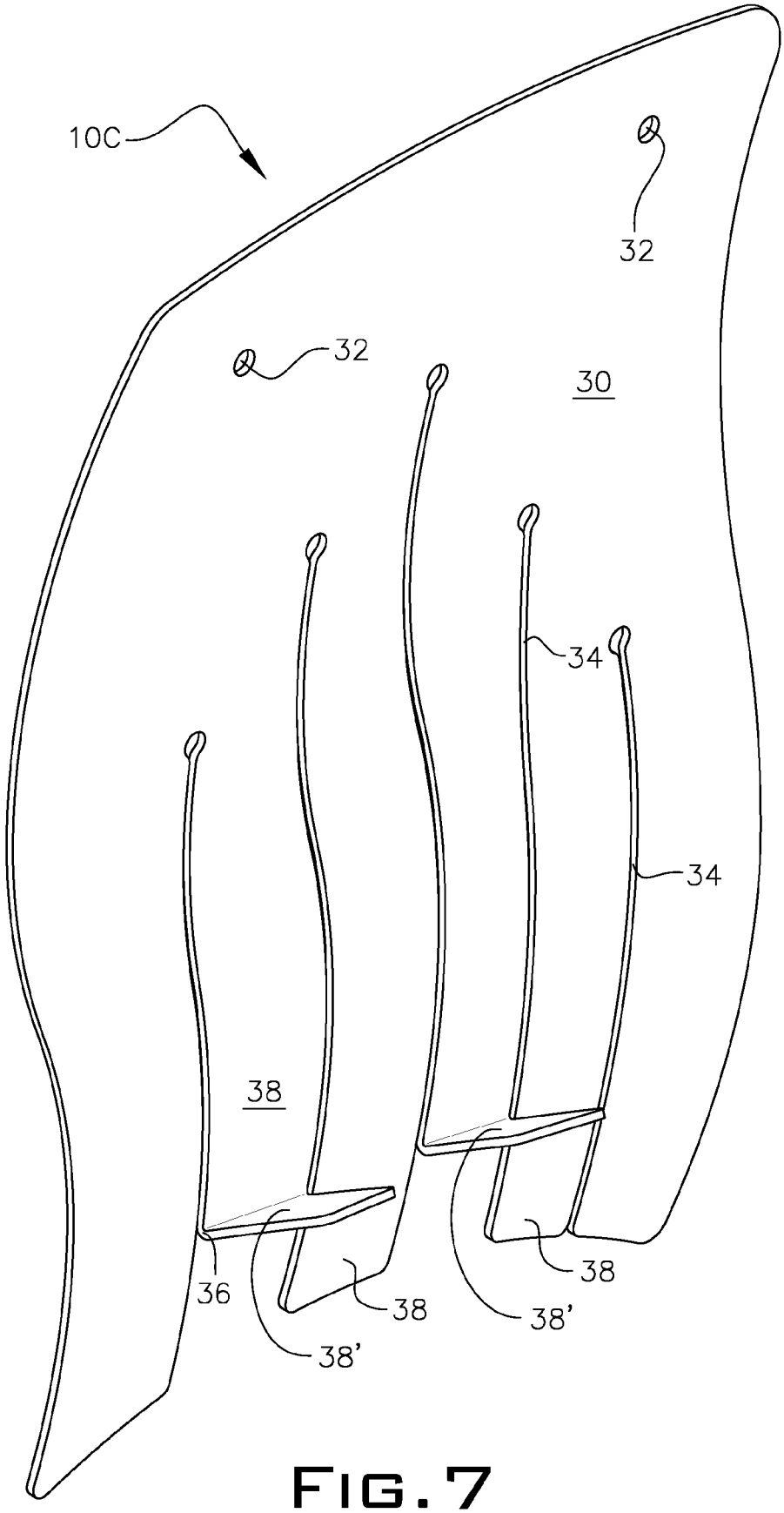
FIG. 7 is an example of a slotted suspendable gong-like percussion instrument where the slots are open slots of same of unequal lengths extending to an outer edge of the instrument with one or more folded portions at the end of the formed cantilevers.

As shown in FIGS. 5 and 6, an example of the invention 10A is a cymbal 12 with a starting shape which allows substantial amount of material 8 to be bent underneath the edge and also form a resonating air cavity, which increases the amplitude of low frequency vibrations. One such initial shape is a star shape. Another is a square bent into an octagon. In the case of the square which is bent into an octagon, the original mass of the square is retained, thereby increasing the general amplitude or volume capacity of the instrument.

Figure 4:
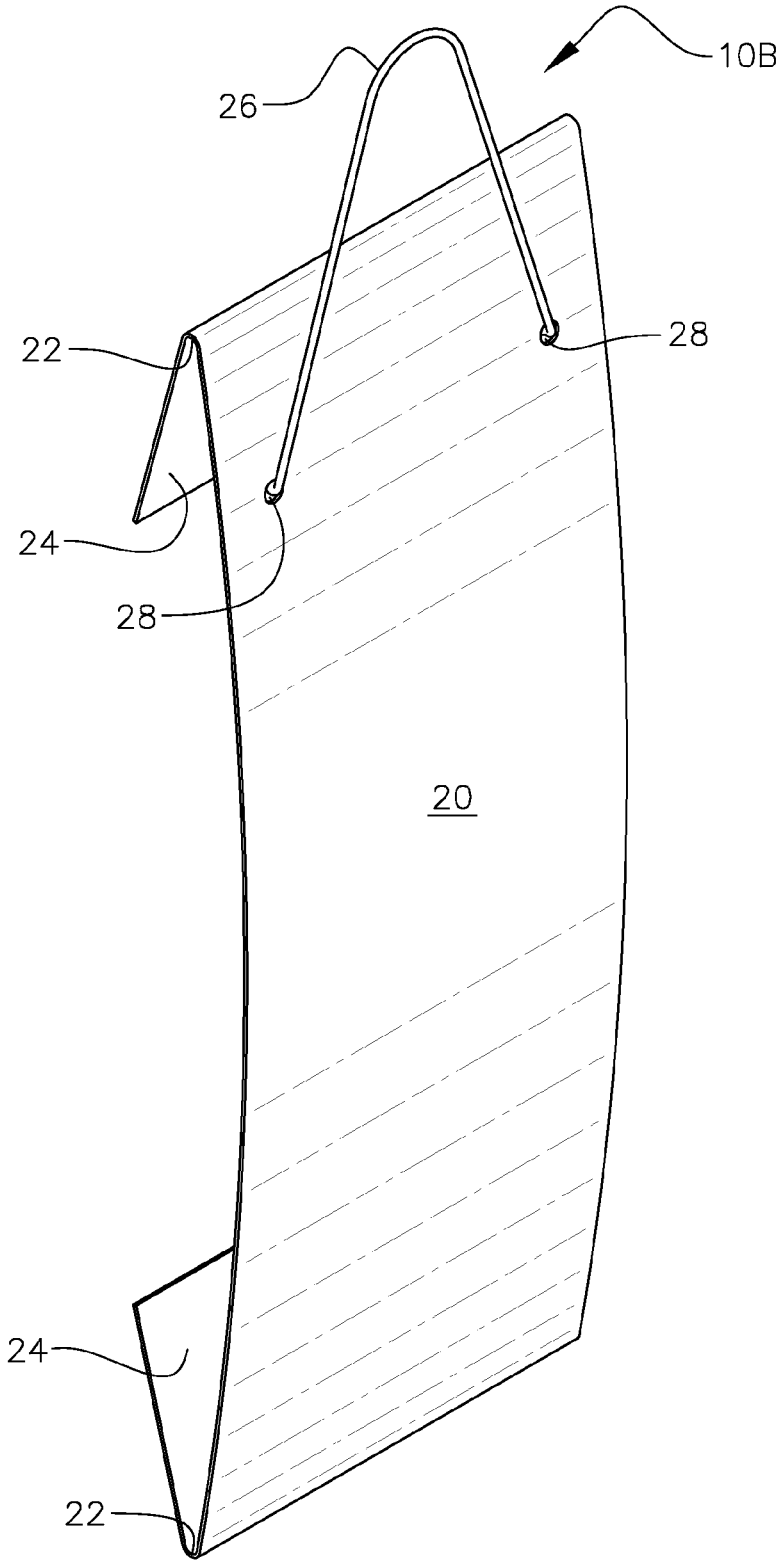
FIG. 4 is an example of a suspendable percussion instrument, which is folded at an upper and lower end of the instrument along a fold line.

Resonating cavity examples are shown to various degrees in each drawing depicting fold lines or bends and are more conspicuously enumerated as 24 in FIGS. 3-4.

A folded instrument such as the embodiments generally depicted as 10B in FIGS. 34 and 10D in FIGS. 8-10, with a straight fold 22,46 can be instantly placed onto (and removed from) an existing cymbal stand arm 48 while a conventional cymbal (not shown) is in use on the stand arm 50. The formed instrument 20,40 can then be struck to produce a percussive, rattling, musical sound. The sound produced will vary according to the materials, shape, and other design factors. The sound can be quite useful as its duration can be very short and concise. Damping materials can also be placed under said instrument to further shorten the duration of said sound.

A nearly instant setup rattle instrument (embodiment generally depicted as 10D in FIGS. 8-10) which when placed upon the horizontal bar or arm 48 of a cymbal stand 50 already in use holding a conventional cymbal (not shown), or any percussion stand arm 50 (FIG. 10), can be struck to produce a loud rattling tone of considerable complexity of overtones. This rattling instrument 10D can be the same instrument as the hanging instruments previously described, and can instantly be removed from the cymbal arm and suspended to produce a more sustained sound described in the embodiment above.

Areas of differing rigidity. An instrument with edges which are folded over has a higher rigidity than an unfolded section. If the outer edges of an instrument are folded, but the inner areas are slotted, the instrument will have a rigid outer edge, with a flexible core. This will allow a slicing motion or striking at an acute angle to the edge to create a sound of quick attack, where a strike or pluck in the center area can create a sound of slower swell.

This invention allows the creation of new and unique complex sounds.

The material of choice is metal for such instruments, but it would be possible to create such an instrument from other materials.

To summarize generally, examples of various embodiments include:

A percussion instrument which is bent or folded along one or more lines, planes, or curves into equal or unequal distinct sections.

A percussion instrument or cymbal, which is bent or folded along one or more lines, planes, or curves into equal or unequal distinct sections, where the instrument has slots cut into the material of the instrument.

A percussion instrument which is bent or folded along one line into equal or unequal distinct sections which form a resonant air cavity.

A percussion instrument which is welded or joined to simulate such folds, wherein a folded bent portion is formed by joining material, for example, in FIGS. 4-5.

A cymbal which is bent or folded along interrupted lines along the edge of said instrument whereby only a portion or portions of said edge is bent or folded.

A gong which is bent or folded along interrupted lines is also contemplated as within the scope of the invention.

A percussion instrument or cymbal which is bent or folded along one or more lines, planes, or curves into equal or unequal distinct sections, wherein the fold causes additional mass or weight to be added to the area adjacent to the sections, causing a change in sound or overtone structure of said instrument.

A folded instrument with a straight fold which can be instantly placed onto (and removed from) an existing cymbal stand arm (with or without damping materials) while a conventional cymbal is in use on the stand arm. The instrument can be struck to produce a percussive, rattling, musical sound. The instrument could also be removed from the cymbal stand arm and hung onto a loop of flexible cord to use as a bell, gong, or hybrid percussion instrument.

A quick change rattle instrument which when placed upon the horizontal bar or arm of a cymbal stand (already in use holding a cymbal), or any percussion stand arm, can be struck to produce a loud rattling tone of considerable complexity of overtones. This rattling instrument can be the same instrument as the hanging instruments previously described, and can instantly be removed from the cymbal arm and place upon a flexible suspension member such as a cord, cable, or chain, to produce a more sustained sound.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A percussion instrument, wherein said instrument comprises a single transverse straight bent or folded area which is configured for facilitating a rapid and easy placement and removal of said instrument on or off of a generally horizontal existing cymbal stand arm, wherein said instrument can be struck to produce a percussive rattling sound by buzzing against a tube of said cymbal stand arm, wherein said instrument requires no fasteners or cords or mounting holes in order to mount on said arm, wherein an end of said cymbal stand can simultaneously by used to mount a conventional cymbal without interference between said instrument and said cymbal.

2. The percussion instrument according to claim 1, wherein said instrument is shaped and bent or folded so as to form a resonant air cavity.

3. The percussion instrument according to claim 1, wherein said instrument is made from a bronze alloy material which is composed of between 6 and 15% tin, and the remainder primarily copper, wherein said alloy is made using a process where an addition of iron and nickel is used to refine and reduce grain size and hence, increase strength, said addition of iron and nickel being in the range of between 0.05 and 0.20% each.

* * * * *